US010648445B2

(12) United States Patent
Anderson et al.

(10) Patent No.: US 10,648,445 B2
(45) Date of Patent: May 12, 2020

(54) SHIELDED SPARK PLUG EXTENSION FOR CONVENTIONAL SPARK PLUGS

(71) Applicant: CUMMINS INC., Columbus, IN (US)

(72) Inventors: Alan C. Anderson, Columbus, IN (US); Irvin P. Rutan, Norman, IN (US)

(73) Assignee: Cummins Inc., Columbus, IN (US)

( * ) Notice: Subject to any disclaimer, the term of this patent is extended or adjusted under 35 U.S.C. 154(b) by 116 days.

(21) Appl. No.: 15/546,470

(22) PCT Filed: Jan. 29, 2016

(86) PCT No.: PCT/US2016/015692
§ 371 (c)(1),
(2) Date: Jul. 26, 2017

(87) PCT Pub. No.: WO2016/123501
PCT Pub. Date: Aug. 4, 2016

(65) Prior Publication Data

US 2018/0030947 A1 Feb. 1, 2018

Related U.S. Application Data

(60) Provisional application No. 62/109,295, filed on Jan. 29, 2015.

(51) Int. Cl.
*F02P 13/00* (2006.01)
*F02P 3/02* (2006.01)
(Continued)

(52) U.S. Cl.
CPC ..... *F02P 13/00* (2013.01); *F02F 1/00* (2013.01); *F02F 1/242* (2013.01); *F02P 3/02* (2013.01);
(Continued)

(58) Field of Classification Search
CPC .... F02P 13/00; F02P 3/02; F02F 1/242; F02F 1/00; H01T 13/04; H01T 13/08; H01F 27/28; H01F 38/12
See application file for complete search history.

(56) References Cited

U.S. PATENT DOCUMENTS 4,715,337 A * 12/1987 Bohl ..... F02P 13/00 123/169 PA
4,944,259 A 7/1990 Richardson
(Continued)

OTHER PUBLICATIONS

International Search Report and Written Opinion dated Apr. 8, 2016 in PCT/US16/15692.
(Continued)

*Primary Examiner* — Joseph J Dallo
(74) *Attorney, Agent, or Firm* — Faegre Drinker Biddle & Reath LLP

(57) ABSTRACT

A shielded ignition configuration is provided comprising a non-shield spark plug having an electrode, a spark plug extender having first end configured to mount to the spark plug such that a conductor of the extender makes electrical contact with the spark plug electrode, a second end having a cup configured for connection to a secondary lead such that the conductor makes electrical contact with the secondary lead, and a flange, and at least one retainer configured to engage the flange and cause a lower surface of the flange to engage an upper surface of a valve cover.

21 Claims, 7 Drawing Sheets

(51) Int. Cl.

| | |
|---|---|
| ***F02F 1/00*** | (2006.01) |
| ***F02F 1/24*** | (2006.01) |
| ***H01T 13/04*** | (2006.01) |
| ***H01T 13/08*** | (2006.01) |
| *H01F 38/12* | (2006.01) |
| *H01F 27/28* | (2006.01) |

(52) U.S. Cl.
CPC ..... *H01T 13/04* (2013.01); *H01T 13/08* (2013.01); *H01F 27/28* (2013.01); *H01F 38/12* (2013.01)

(56) References Cited

U.S. PATENT DOCUMENTS 5,038,745 A 8/1991 Krappel et al.
5,060,624 A * 10/1991 Bruning ..... F02F 1/242 123/169 PA
5,664,954 A * 9/1997 Rea ..... H01R 13/5213 439/125
5,697,334 A * 12/1997 Below ..... H01T 13/08 123/169 R
5,716,223 A * 2/1998 Phillips, Jr. ..... H01T 13/06 439/125
5,918,571 A * 7/1999 Below ..... H01T 13/08 123/169 E
6,104,130 A * 8/2000 Below ..... H01T 13/08 123/169 EL
6,114,933 A 9/2000 Widiger et al.
6,582,220 B2 * 6/2003 Heck ..... F23Q 3/006 313/11.5
6,698,411 B2 * 3/2004 Maekawa ..... H01F 38/12 123/634
6,817,872 B1 11/2004 Berg
7,594,489 B1 * 9/2009 Marrs ..... H01T 13/04 123/143 C
7,825,573 B2 11/2010 Callahan et al.
8,164,241 B2 4/2012 Miller et al.
8,365,710 B2 * 2/2013 Lykowski ..... F02B 19/12 123/169 PA

OTHER PUBLICATIONS

International Preliminary Report on Patentability dated Dec. 18, 2016 in PCT/US16/15692.

* cited by examiner

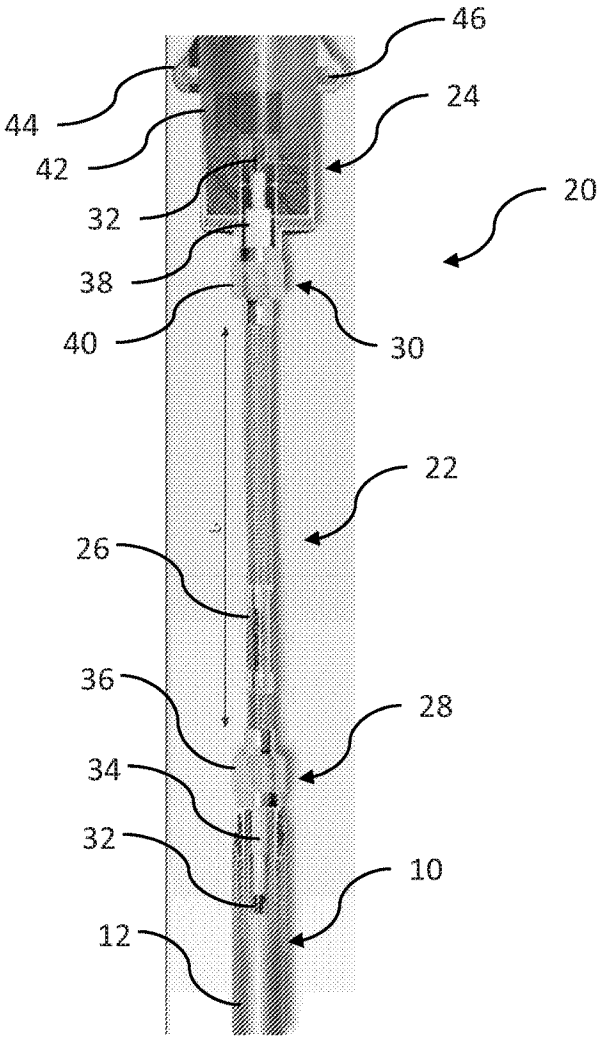
(B)
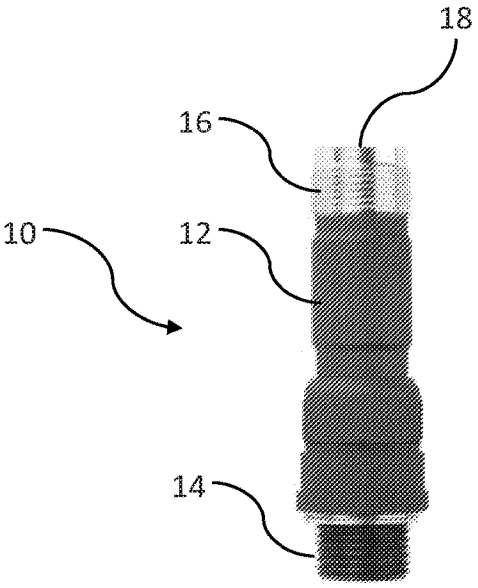
(A)
FIGURE 1 – Prior Art

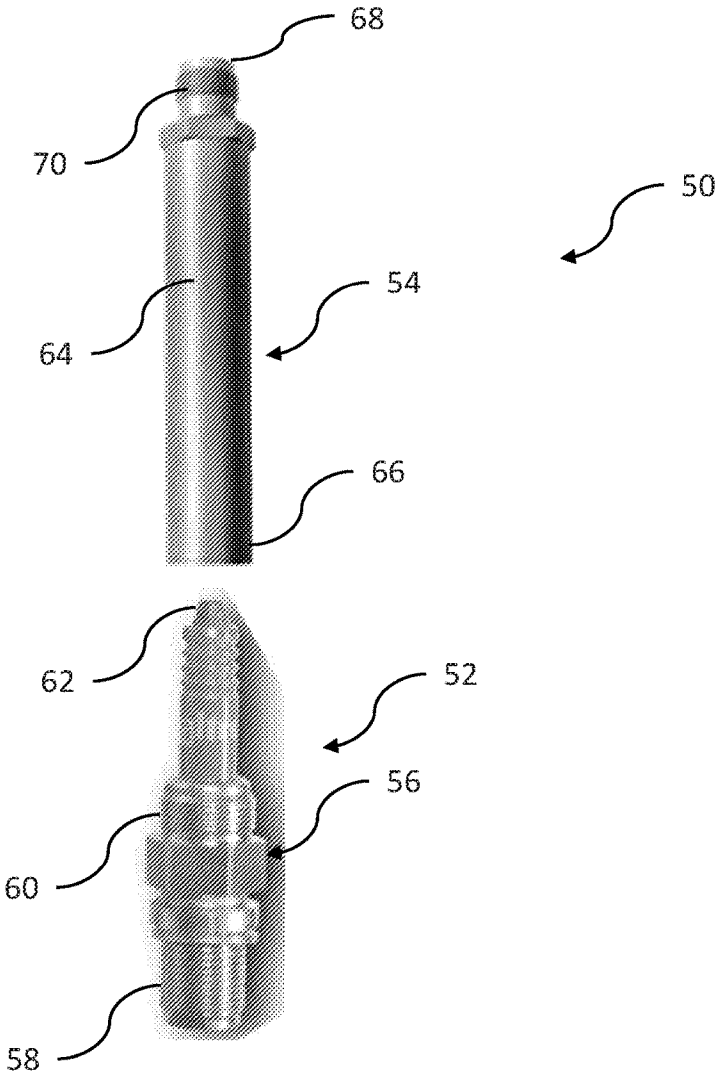
FIGURE 2 – Prior Art

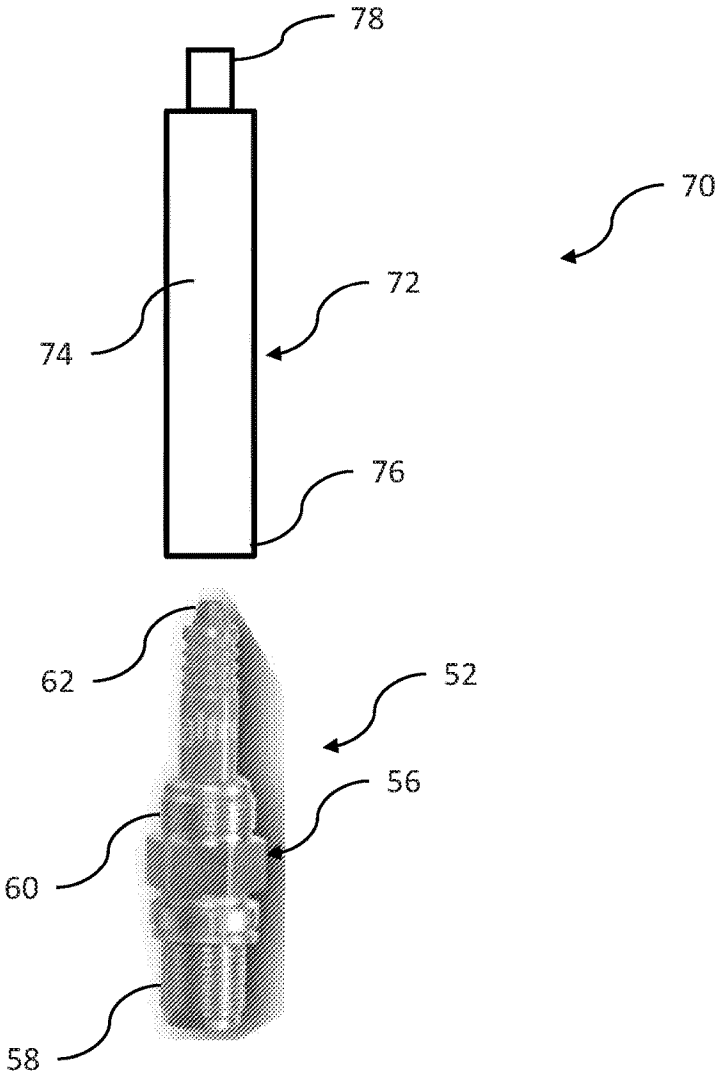
FIGURE 3 – Prior Art

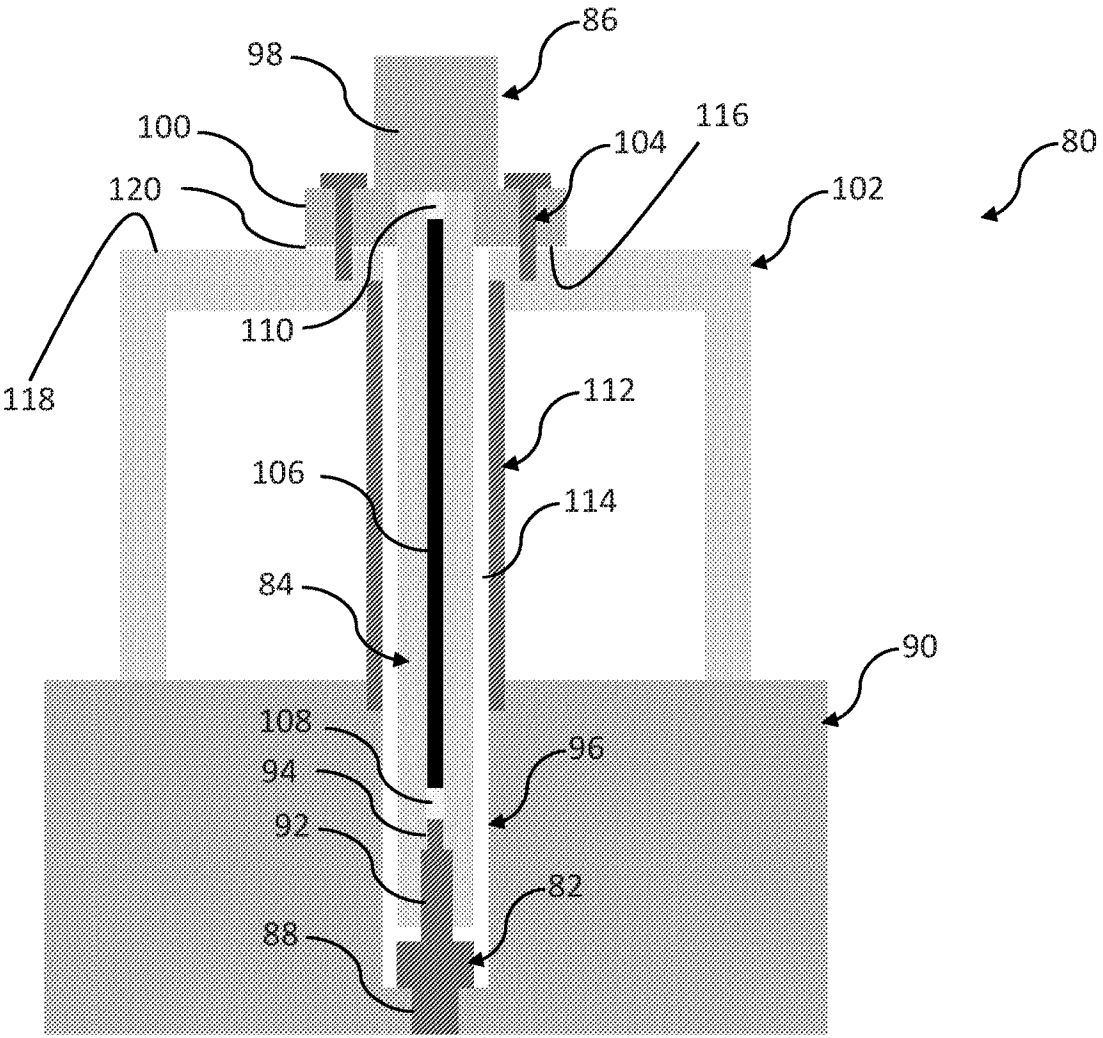
FIGURE 4 – Prior Art

SHIELDED SPARK PLUG EXTENSION FOR CONVENTIONAL SPARK PLUGS

RELATED APPLICATIONS

The present application is a national phase filing under 35 U.S.C. § 371 of International Application No. PCT/US16/15692, titled "SHIELDED SPARK PLUG EXTENSION FOR CONVENTIONAL SPARK PLUGS," filed on Jan. 29, 2016, which claims the benefit of priority to U.S. Provisional Application No. 62/109,295, filed on Jan. 29, 2015, the entire disclosures of which being expressly incorporated herein by reference.

PRIORITY CLAIM

This application claims priority to U.S. Provisional Application No. 62/109,295, which is entitled "SHIELDED SPARK PLUG EXTENSION FOR CONVENTIONAL SPARK PLUGS," and was filed on Jan. 29, 2015, the entire disclosure of which is expressly incorporated herein by reference in its entirety.

TECHNICAL FIELD

The present invention relates generally to ignition configurations for engines, and more specifically to shielded ignition configurations using standard spark plugs that permit remote mounting of standard or shielded ignition coils.

BACKGROUND

In some engine applications, a shielded ignition system is required to meet hazardous area requirements (i.e., to prevent ignition of gases surrounding the engine) or to prevent electrical noise/interference with surrounding electronics (e.g., on aircraft). Some shielded ignition configurations use shielded spark plugs mounted to the cylinder head and connected via flexible shielded secondary leads to remotely mounted ignition coils. While such configurations permit mounting of ignition coils away from the high temperature high vibration conditions associated with mounting to the engine valve cover, such configurations also require use of shielded spark plugs, which are generally more expensive than standard spark plugs and are available in more limited configurations. In other shielded ignition configurations, an integral spark plug is mounted to the cylinder head and connected via a shielded spark plug adapter to a flexible secondary lead coupled to a remotely mounted ignition coil. Again, however, integral spark plugs are generally more expensive than standard spark plugs and are available in more limited configurations. In still other shielded configurations, an integral spark plug is mounted to the cylinder head and connected directly to a shielded ignition coil. These configurations suffer from the problems associated with integral and/or shielded spark plugs. Also, the cantilevered mass of the coil places stress on the spark plug and subjects the coil to increased vibration loads, among other things. Also, in some applications limited space prevents direct connection of the ignition coil to the spark plug. In still other shielded configurations, a conventional or standard spark plug is mounted to the cylinder head and connected via a shielded spark plug extender to a valve cover mounted ignition coil. While these configurations permit use of standard spark plugs, the mounting of the ignition coil to the valve cover exposes the coil to a high temperature and high vibration operating environment, reducing the useful life of the coil and degrading the overall performance of the ignition configuration.

Consequently, it is desirable to provide an ignition configuration which permits use of standard spark plugs, but does not require mounting of ignition coils to the valve cover (i.e., permits remote mounting of the coils to reduce temperature and vibration exposure of the coils).

SUMMARY

According to one embodiment, the present disclosure provides a shielded ignition configuration, comprising a non-shielded spark plug having an electrode, a spark plug extender having first end configured to mount to the spark plug such that a conductor of the extender makes electrical contact with the spark plug electrode, a second end having a cup configured for connection to a secondary lead such that the conductor makes electrical contact with the secondary lead, and a flange, and at least one retainer configured to engage the flange and cause a lower surface of the flange to engage an upper surface of a valve cover. In one aspect of this embodiment, the at least one retainer comprises a plurality of fasteners that extend through a corresponding plurality of openings in the flange and into a plurality of openings in the valve cover. In another aspect, the at least one retainer comprises a central opening through which the second end of the extender extends, and a plurality of internal threads that mate with corresponding threads formed onto the valve cover. In still another aspect, the at least one retainer comprises a plate having a central opening through which the second end of the extender extends, and a plurality of fasteners that extend through a corresponding plurality of openings in the plate and into a plurality of openings in the valve cover.

In still another aspect, the first end comprises a receptacle structured for coupling to the spark plug and wherein the spark plug extender mounts to the spark plug by way of the receptacle. In a variant of this aspect, the receptacle comprises at least one of a seal and a boot disposed within the receptacle to cause a system dielectric strength to change from a first strength value to a second strength value, the second strength value being greater than the first strength value. In still another aspect, the shielded ignition configuration further includes a spark plug tube positioned in an opening of the valve cover, a first gap intermediate the first end and a body of the non-shielded spark plug, and a second gap intermediate an inner wall of the spark plug tube and the spark plug extender. In a variant of this aspect, the first gap is in fluid communication with the second gap such that blow-by gases from a combustion chamber flows from the first gap toward the second gap thereby mitigating corrosion of the spark plug.

In another embodiment, the present disclosure provides a shielded spark plug extender, comprising an elongate body having a first end and a second end, a receptacle disposed at the first end configured for coupling to a standard spark plug, a cup disposed at the second end, the second end having threads to engage corresponding threads on a secondary lead to retain the secondary lead in contact with the cup, a conductor extending between the receptacle and the cup, the conductor providing electrical connection between the spark plug and the cup, a flange extending outwardly from the body adjacent the second end, the flange having a lower surface for engaging an upper surface of a valve cover, and at least one retainer configured to engage the valve cover to retain the lower surface of the flange in engagement with the upper surface of the valve cover. In one aspect of this embodiment, the at least one retainer comprises a plurality of fasteners that extend through a corresponding plurality of openings in the flange and into a plurality of openings in the valve cover. In another aspect, the at least one retainer comprises a central opening through which the second end of the extender extends, and a plurality of internal threads that mate with corresponding threads formed onto the valve cover.

In still another aspect, the at least one retainer comprises a plate having a central opening through which the second end of the extender extends, and a plurality of fasteners that extend through a corresponding plurality of openings in the plate and into a plurality of openings in the valve cover. In still another aspect, the shielded spark plug extender further includes a seal positioned intermediate an interface defined by the lower surface of the flange and the upper surface of the valve cover, the seal structured to inhibit flow of combustion gases from a combustion chamber past the first interface. In still another aspect, the receptacle comprises at least one of a seal and a boot disposed within the receptacle to cause a system dielectric strength to change from a first strength value to a second strength value, the second strength value being greater than the first strength value.

In yet another embodiment, the present disclosure provides an engine, comprising a cylinder head having at least one spark plug cavity formed therein, a valve cover mounted to the cylinder head, the valve cover having an upper surface, a spark plug mounted in the spark plug cavity, a coil mounted to the engine remotely of the valve cover, a secondary lead coupled to the coil, a spark plug tube extending between the cylinder head and the valve cover, and a shielded spark plug extender. The spark plug extender has an elongate body extending through the tube having a first end extending from the tube into the spark plug cavity and a second end extending from the tube and through the upper surface of the valve cover, a receptacle disposed at the first end configured for coupling to the spark plug, the receptacle having a contact for contacting an electrode of the spark plug, a cup disposed at the second end, the second end having threads to engage corresponding threads on the secondary lead to retain the secondary lead in contact with the cup, a conductor extending between the receptacle and the cup, the conductor providing electrical connection between the spark plug and the cup, a flange extending outwardly from the body adjacent the second end, the flange having a lower surface for engaging the upper surface of the valve cover, and at least one retainer configured to engage the valve cover to retain the lower surface of the flange in engagement with the upper surface of the valve cover.

In one aspect of this embodiment, the at least one retainer comprises a plurality of fasteners that extend through a corresponding plurality of openings in the flange and into a plurality of openings in the valve cover. In another aspect, the at least one retainer comprises a central opening through which the second end of the extender extends and a plurality of internal threads that mate with corresponding threads formed onto the valve cover. In still another aspect, the at least one retainer comprises a plate having a central opening through which the second end of the extender extends, and a plurality of fasteners that extend through a corresponding plurality of openings in the plate and into a plurality of openings in the valve cover. In still another aspect, the receptacle comprises at least one of a seal and a boot disposed within the receptacle to cause a system dielectric strength to change from a first strength value to a second strength value, the second strength value being greater than the first strength value. In still another aspect, the engine further includes a first gap intermediate the first end and a body of the spark plug, and a second gap intermediate an inner wall of the spark plug tube and the shielded spark plug extender. In a variant of this aspect, the first gap is in fluid communication with the second gap such that blow-by gases from a combustion chamber flows from the first gap toward the second gap thereby mitigating corrosion of the spark plug.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein:

FIG. 1A is a side view of a prior art shielded spark plug;

FIG. 1B is a side view of a prior art ignition configuration including the spark plug of FIG. 1A;

FIG. 2 is a side view of another prior art ignition configuration including an integral spark plug and a shielded spark plug adaptor;

FIG. 3 is a side view of another prior art ignition configuration including the integral spark plug of FIG. 2 and a shielded integral ignition coil;

FIG. 4 is a side view of another prior art ignition configuration including a conventional spark plug and a valve cover mounted shielded ignition coil;

Figure 5:
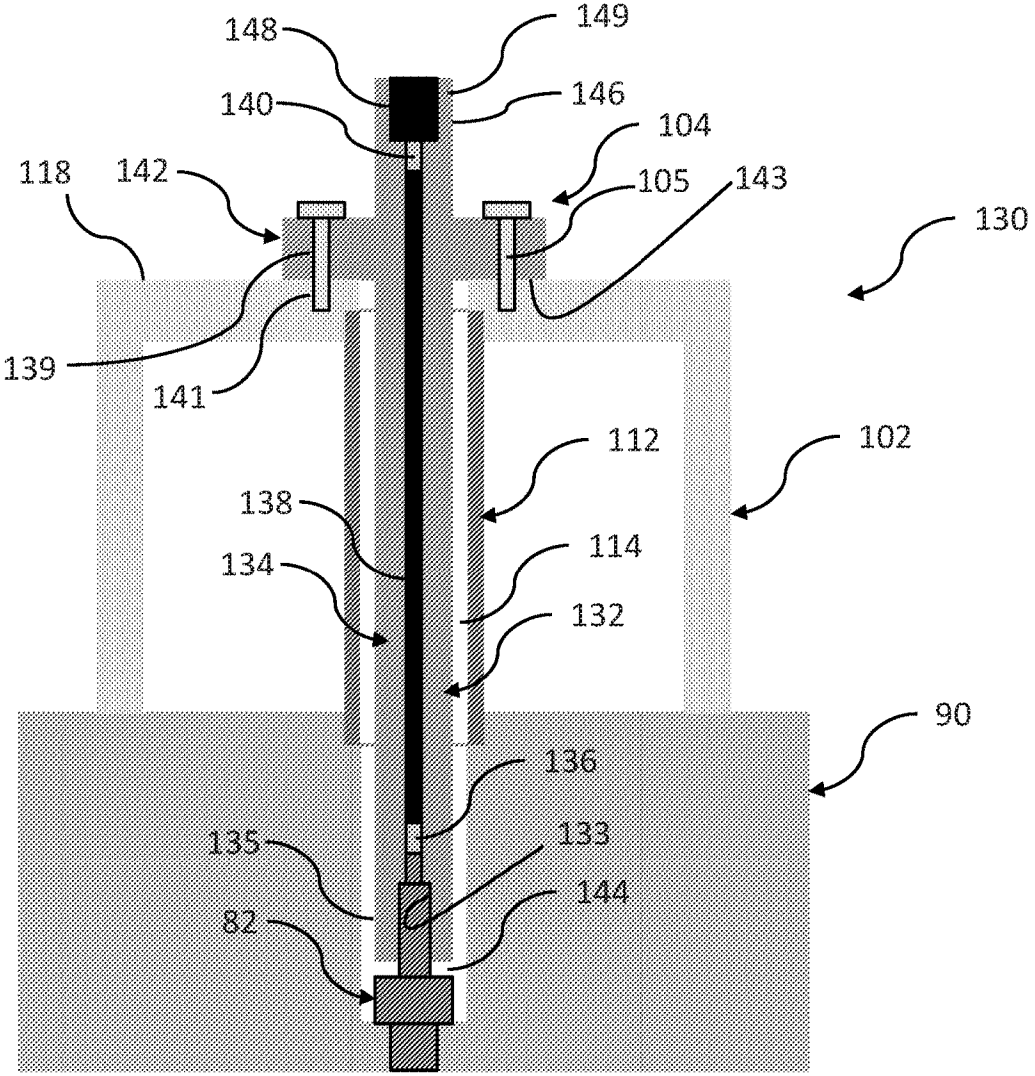
FIG. 5 is a side view of an ignition configuration according to one embodiment of the present disclosure.

While the present disclosure is amenable to various modifications and alternative forms, specific embodiments have been shown by way of example in the drawings and are described in detail below. The present disclosure, however, is not to limit the particular embodiments described. On the contrary, the present disclosure is intended to cover all modifications, equivalents, and alternatives falling within the scope of the appended claims.

DETAILED DESCRIPTION

Referring now to FIG. 1A, a shielded spark plug 10 is depicted as having a shielded spark plug body 12 which prevents a spark from emanating from the spark plug. The spark plug body 12 includes a threaded end 14 for engaging with corresponding threads (not shown) in a cylinder head (not shown) of an engine. As is understood by those skilled in the art, a spark is produced by spark plug 10 in the engine cylinder to ignite a fuel/air mixture in the cylinder associated with the spark plug. In this prior art embodiment, spark plug body 12 further includes a second threaded end 16 surrounding a cup 18 for coupling to a flexible shielded secondary lead (described below) which delivers electrical energy from a coil coupled to the secondary lead to generate the spark at end 14 of the spark plug 10 as described below.

In the prior art configuration 20 depicted in FIG. 1B, shielded spark plug 10 is coupled to a flexible shielded secondary lead 22 which is coupled to a shielded spark plug coil 24. As shown, secondary lead 22 includes a flexible body 26 having a first end 28 and a second end 30. A conductor 32 extends through flexible body 26 between first end 28 and second end 30. End 28 of secondary lead 22 includes an insulator 34 which is configured to fit within spark plug body 12 with an end of conductor 32 in contact with an electrode (not shown) in spark plug body 12. End 28 further includes a nut 36 which surrounds body 26 and includes internal threads (not shown) that engage with threads 16 of spark plug 10 to secure end 28 of secondary lead 22 to spark plug 10. End 30 of secondary lead 22 similarly includes an insulator 38 which is configured to fit within a cup (not shown) of coil 24 with an end of conductor 32 in contact with a conductor in coil 24. End 30 further includes a nut 40 which surrounds body 26 and includes internal threads (not shown) that engage with threads (not shown) on the outer surface of the cup of coil 24 to secure end 30 of secondary lead 22 to spark plug coil 24. It should be understood that secondary lead 22 may extend within a spark plug tube as described below with reference to the embodiments of the present disclosure. Coil 24 includes a shielded housing 42 having a pair of flanges 44, each with a through hole 46 for receiving a fastener (not shown) to mount coil 24 to a surface. It should be understood that coil 24 may have a single flange or more than two flanges and is mounted to an engine or vehicle surface other than the engine valve cover.

Configuration 20 permits remote mounting of shielded spark plug coil 24, but except as described below, requires use of shielded spark plug 10 (as opposed to a standard spark plug) in applications required to meet government regulations for hazardous areas (i.e., areas having potentially explosive gases surrounding the engine that may be ignited by a flame created by the spark plug). Unlike conventional flange mount coil configurations (as described below) wherein the coil is typically mounted to the valve cover which imparts relatively high temperatures to the coil through conduction, in configuration 20 shielded coil 24 may be mounted in a variety of locations on the engine as a result of the use of flexible shielded secondary lead 22. In this manner, coil 24 may be mounted in a location that permits good air circulation (for cooling of the coil), minimal conducted heat, and vibration isolation. However, the use of shielded spark plug 10 has drawbacks. Not all engine applications need shielded systems, so configuration 20 has limited applicability. Also, shielded spark plugs are generally more expensive than conventional spark plugs, and they are provided with fewer options such as thread size, heat range, and electrode design (in terms of long life materials and configuration). Moreover, use of a shielded spark plug such as in configuration 20 provides inferior handling of leakage gases. While not shown in FIG. 1B, the portion of secondary lead 22 that extends from spark plug 10 is typically enclosed within a spark plug tube which contains combustion gases from the cylinder that pass through the spark plug. As explained in co-pending and co-owned U.S. patent application Ser. No. 14/487,636, entitled "VENTED SPARK PLUG TUBE WITH FLAME ARRESTOR," filed on Sep. 16, 2014 (hereinafter, "the Flame Arrestor Application"), the entire contents of which being expressly incorporated herein by reference, spark plugs mounted to a cylinder head do not prevent all gases from the combustion chamber from passing through the spark plug/cylinder head interface. When spark plugs are mounted within a spark plug tube such as in configuration 20, liquids may condense out from built up combustion gas in the tube and corrode or otherwise degrade the performance of the spark plug or the ignition configuration in general. With shielded spark plug 10 in particular, the condensate from the leakage or blow-by gas may collect in cup 18 and may cause corrosion of spark plug 10 and/or secondary lead 22 and a degradation of the ignition system performance. It should be understood, however, that the venting systems and methods disclosed in the Flame Arrestor Application may be used with configuration 20. It should further be understood that a shielded spark plug is typically not used with a spark plug tube, primarily due to the difficulty of tightening nut 36 on the spark plug lead when located down a tube. Accordingly, the main corrosion mechanism is that the leakage gases are trapped within the shielded system of spark plug, lead, and coil. There is no known venting mechanism (other than leakage past the threads) for these components. The integral coil and integral spark plug connection is similar. The leakage occurs between the threads 60 and the insulator. The leakage is then trapped within the cavity of the integral coil. A similar situation occurs if a shielded extension is used with an integral spark plug.

Another prior art ignition configuration is depicted in FIG. 2. Configuration 50 includes an integral spark plug 52, an adapter 54 and a secondary lead (not shown) coupled to a remote mounted coil (not shown). Integral spark plug 52 includes a body 56 having threads 58 at one end that mate with threads in the cylinder head (not shown) to attach spark plug 52 to the cylinder head, threads 60 at another end and an electrode 62. Adapter 54 includes a shielded body 64 with an internal opening or receptacle (not shown) and conductor (not shown) within adapter 54. Internal threads (not shown) at end 66 of body 64 mate with threads 60 of spark plug 52. Electrode 62 of spark plug 52 contacts a conductor (not shown) within adapter 54 which extends to a cup 68 of adapter 54. Cup 68 includes threads 70 which mate with a nut of a secondary lead (such as nut 36 of FIG. 1B) to complete the electrical connection from a remote mounted coil to spark plug 52 in the manner described above.

Configuration 50 also provides the benefits of a remotely mounted coil (i.e., a lower temperature environment for the coil, reduced vibration, and improved life expectancy). However, integral spark plugs 52 (like shielded spark plug 10) are generally more expensive than conventional spark plugs, and they are provided with fewer options such as thread size, heat range, and electrode design (in terms of long life materials and configuration). Also, blow-by gas from the combustion chamber may condense within adapter 54 and corrode the adapter 54 and/or integral spark plug 52, thereby degrading the performance of the ignition system.

Yet another prior art configuration is depicted in FIG. 3. Configuration 70 includes integral spark plug 52, and a shielded integral coil 72. Integral spark plug 52 is identical to that described above with reference to FIG. 2. Integral coil 72 includes a shielded body 74 with an internal opening (not shown) and conductor (not shown). Internal threads (not shown) at end 76 of body 74 mate with threads 60 of spark plug 52. Electrode 62 of spark plug 52 contacts a conductor (not shown) within end 76 of coil 72 which provides an electrical charge to spark plug 52. Coil 72 further includes a terminal 78 which connects to the engine electrical system. In this manner, coil 72 is mounted directly to spark plug 52, typically within the valve cover of the engine.

Configuration 70 is undesirable for a variety of reasons. Integral spark plugs 52, like shielded spark plugs, are generally more expensive than conventional spark plugs, and they are provided with fewer options such as thread size, heat range, and electrode design (in terms of long life materials and configuration). Integral coil 72 options are similarly limited. Additionally, in some applications an integral coil 72 will not fit within the available space. Also, the cantilevered mounting configuration of coil 72 onto spark plug 52 results in high vibration and stresses on coil 72 and spark plug 52, which along with the high temperature environment of coil 72 (i.e., within the valve cover) reduce the useful life of configuration 70. Finally, blow-by gas from the combustion chamber may condense within coil 72 and corrode coil 72 and/or integral spark plug 52, thereby degrading the performance of the ignition system.

FIG. 4 depicts still another prior art configuration 80 of an ignition system. Configuration 80 includes a conventional or standard spark plug 82, a conventional spark plug extender 84, and a shielded flange mount ignition coil 86. Configuration 80 is substantially the same as the shielded ignition assembly 10 described in detail in the Flame Arrestor Application with reference to FIG. 1 therein. Spark plug 82 includes threads 88 for mounting spark plug 82 to cylinder head 90, an insulated body 92, and an electrode 94. As shown, spark plug 82 is mounted within a spark plug cavity 96 formed in cylinder head 90. Conventional spark plug extender 84 extends between and electrically connects spark plug 82 to coil 86. Coil 86 includes a coil body 98 and a flange 100 for mounting coil 86 to valve cover 102 using fasteners 104. Extender 84 includes a center conductor 106, a spring connector 108 connected to conductor 106 and providing an electrical connection to spark plug electrode 94, and a spring connector 110 connected to conductor 106 and providing an electrical connection to coil 86. Extender 84 is mounted within a spark plug tube 112 that extends between cylinder head 90 and valve cover 102.

As depicted in FIG. 4, spark plug 82 is mounted within spark plug cavity 96 of cylinder head 90, typically near the center of the cylinder bore (not shown). Access to spark plug 82 is typically gained through the top of valve cover 102 (by removing coil 86 and extender 84). Spark plug tube 112 prevents engine lube oil and/or coolant within valve cover 102 from entering the spark plug cavity 96 and corroding or contaminating the high voltage connection between spark plug 82 and conductor 106 through spring connector 108. Thus, it is desirable that tube 112 provide a leak proof barrier around extender 84.

The primary issue with configuration 80 is that coil 86 is mounted to valve cover 102. Such mounting results in high heat and vibration to coil 86. Configuration 80 partially addresses the above-described problem of gas build up and condensation. More specifically, in assembly 80 as combustion gas builds up in gap 114 it is vented to atmosphere through the interface between coil 86 and valve cover 102. Flange 100 of coil 86 has a lower surface 116 that contacts an upper surface 118 of valve cover 102. This metal-to-metal interface leaves a small gap 120 even if coil 86 is tightly attached to valve cover 102 by fasteners 104. When the pressure of gas within gap 114 is sufficiently high, the gas will escape to atmosphere through gap 120. While this configuration reduces the risk that liquids will condense out of combustion gas in gap 114 and contaminate spark plug chamber 96, it presents a risk that liquids will pass through gap 120 and collect within spark plug chamber 96. It also presents a risk that combustion gas within gap 114 will ignite and produce a flame through gap 120 that may ignite gases surrounding the engine. Regarding the former, for example, the process of servicing an engine typically includes cleaning the engine, usually by power-washing the engine using very high pressure water. Such water may pass through gap 120 and contaminate spark plug chamber 96. Additionally regarding the latter, configuration 80 may not be suitable for use in hazardous environments because it is possible for a flame, caused by ignition of combustion gas built up in gap 114, to escape through gap 120 and ignite gases surrounding the engine.

One way to reduce the risk of ingress of liquids and egress of flames through gap 120 is to use a weather seal or gasket between flange 100 of coil 86 and valve cover 102. Such a weather seal may, however, also permit combustion gas pressure to build up in tube 112 (i.e., within gap 114) until an equilibrium pressure is established between gap 114 and the corresponding combustion chamber. Upon cooling during engine shut down, for example, liquids could then condense out of the pressurized gas in gap 114 and potentially cause corrosion to spark plug 82 and/or extender 84. The disclosure of the Flame Arrestor Application addresses this deficiency in the prior art by providing configurations that permit use of a weather seal between flange 100 and valve cover 102 by venting the pressurized gas in gap 114 in a manner that reduces potential corrosion of spark plug 82 and/or extender 84 and prevents a flame from passing through gap 120 that could ignite gases in the external environment of the engine. These same teachings may be applied to the configurations of the present disclosure described below.

Configuration 80 permits use of conventional spark plugs 82, which are generally less expensive than shielded spark plugs or integral spark plugs and are available with more options (in terms of thread size, heat range, and electrode design (i.e., long-life materials and configuration)). Moreover, when the teachings of the Flame Arrestor Application are applied to configuration 80, the problems of corrosion and ignition of external gases may be substantially eliminated. However, configuration 80 still suffers from the drawbacks associated with flange mounted coils. More specifically, as coil 86 is mounted directly to valve cover 102, coil 86 is exposed to the high temperatures associated with valve cover 102 resulting from high temperature engine coolant and lubrication enclosed therein. Also, vibration from combustion events in the engine cylinders is transferred from cylinder head 90 to valve cover 102 and to coil 86. Both of these operating conditions (i.e., high temperature and high vibration) tend to degrade the performance and reduce the useful life of coil 86.

FIG. 5 depicts an ignition configuration 130 according to the principles of the present disclosure. Configuration 130 includes a conventional spark plug 82, a shielded spark plug extender 132, and a spark plug tube 112. Conventional spark plug 82 is the same as that described above with reference to FIG. 4. Spark plug extender 132 includes an elongate body 134 having a lower end 135 with a receptacle 133 that mates with spark plug 82 in the manner described above with reference to spark plug extender 84. In the embodiments described herein, a seal or boot (not shown) may be used within receptacle 133 to maximize the system dielectric strength. Extender 132 further includes a spring contact 136 that provides an electrical connection with spark plug 82 in the manner described above with reference to spark plug extender 84. Spring contact 136 is in electrical contact with conductor 138 of extender 132. The other end of conductor 138 is in electrical contact with another spring contact 140. Extender 132 further includes a flange 142 that extends outwardly from body 134 adjacent an upper end 146 of body 134. Flange 142 is used to mount extender 132 to valve cover 102 using at least one retainer 104 in the manner described below. In this embodiment, at least one retainer 104 includes a plurality of fasteners 105 which extend through openings 139 in flange 142 and thread into openings 141 of valve cover 102. As fasteners 105 are threaded into openings 141, they draw lower surface 143 of flange 142 into engagement with upper surface 118 of valve cover 102. It should be understood that a weather seal may be used between lower surface 143 of flange 142 and upper surface 118 of valve cover 102 to prevent combustion gas within spark plug tube 112 from escaping between the interface between lower surface 143 of flange 142 (which may be constructed of metal or plastic) and upper surface 118 of valve cover 102 as described in the Flame Arrestor Application. As a gap 144 is provided between lower end 135 of body 134 and the body of spark plug 82, blow-by gases may be passed into gap 114 (not trapped within extender 132) and vented using the teachings of the Flame Arrestor Application. Upper end 146 of extender body 134 includes a cup 148 in electrical contact with spring 140. Cup 148 includes threads 149 which mate with a secondary lead 22 (such as that depicted in FIG. 1B). A remote mounted coil (such as coil 24 of FIG. 1B) may then be connected to secondary lead 22 to complete the electrical connection between spark plug 82 and the remote mounted coil.

Thus, configuration 130 provides a shielded ignition configuration that permits use of conventional spark plugs 82, which are generally less expensive than the shielded spark plugs or the integral spark plugs of prior art embodiments and are available with more options (in terms of thread size, heat range, and electrode design (i.e., long-life materials and configuration). Additionally, configuration 130 permits use of a shielded coil (such as coil 24 of FIG. 1B) remotely mounted at a location on the engine that will reduce the temperature imparted to the coil and the vibration associated with a coil mounted to valve cover 102. Also, when the teachings of the Flame Arrestor Application are incorporated into configuration 130, configuration 130 may include a weather seal as described above between lower surface 143 of flange 142 and upper surface 118 of valve cover 102 to prevent ingress of fluids into and egress of flames from gap 114, thereby avoiding corrosion of the electrical connection between spark plug 82 and extender 134 while permitting safe use of configuration 130 in hazardous environments.

Figure 6:
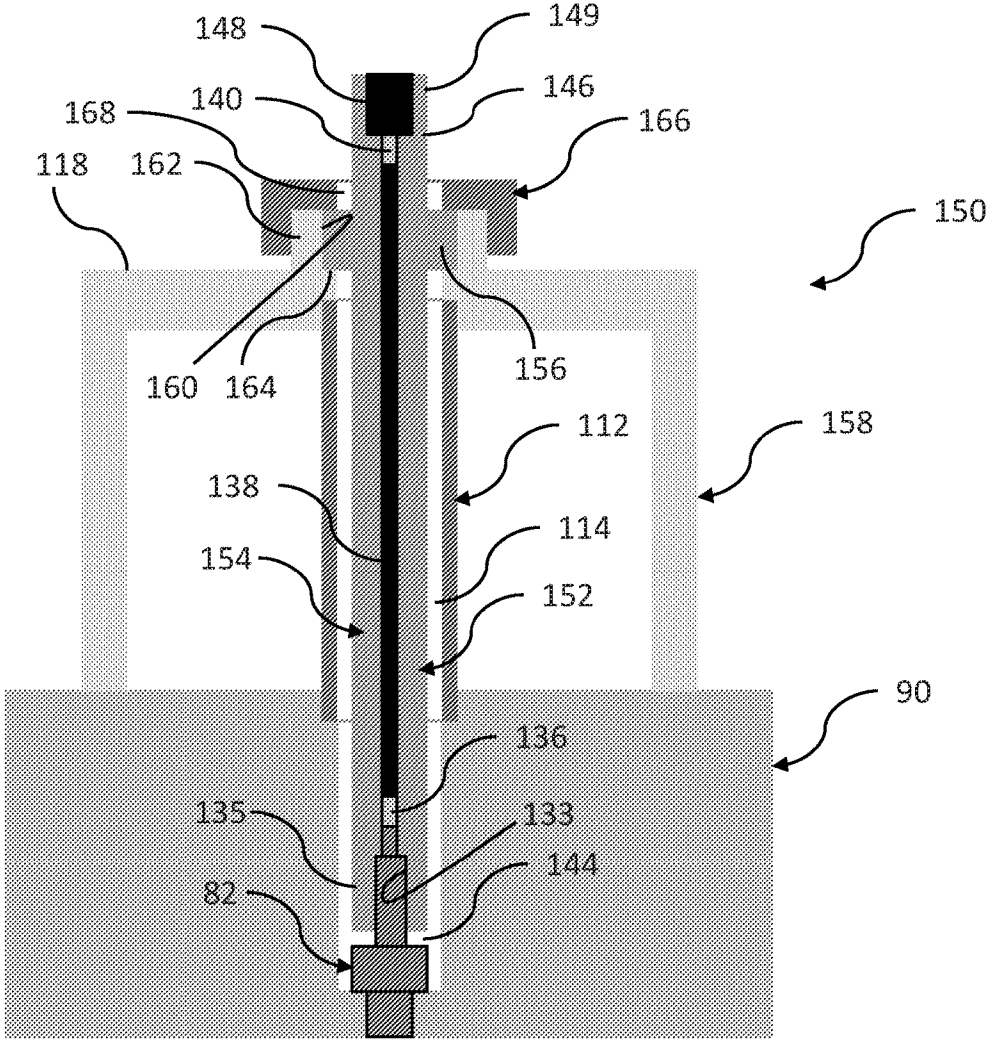
FIG. 6 is a side view of an ignition configuration according to another embodiment of the present disclosure.

Referring now to FIG. 6, another embodiment of an ignition configuration according to the present disclosure is shown. Ignition configuration 150 includes components that are the same as those of configuration 130 of FIG. 5. Thus, for those components the same reference designations are used. Configuration 150 includes a conventional spark plug 82, a shielded spark plug extender 152, and a spark plug tube 112. Conventional spark plug 82 is the same as that described above with reference to FIG. 4. Spark plug extender 152 includes an elongate body 154 having a lower end 135 with a receptacle 133 that mates with spark plug 82 in the manner described above with reference to spark plug extender 84. Extender 152 further includes a spring contact 136 that provides an electrical connection with spark plug 82 in the manner described above with reference to spark plug extender 84. Spring contact 136 is in electrical contact with conductor 138 of extender 152. The other end of conductor 138 is in electrical contact with another spring contact 140. Extender 152 further includes a flange 156 which extends outwardly from body 154 adjacent upper end 146 of body 154. In this embodiment, flange 156 is sized to fit within a recess 160 formed on valve cover 158 by a shoulder 162 which extends upwardly from upper surface 118 of valve cover 158. When extender 152 is positioned onto spark plug 82, a lower surface 164 of flange 156 is in contact with upper surface 118 of valve cover 158. Extender 152 further includes a retainer 166 with a central opening 168 configured to be placed over end 146 of extender 152 and mated with shoulder 162. More specifically, retainer 166 may include internal threads (not shown) that engage external threads (not shown) disposed on an outer surface of shoulder 162. As retainer 166 is rotated onto the external threads of shoulder 162, flange 156 is forced downwardly such that lower surface 164 of flange 156 engages upper surface 118 of valve cover 158 and contact 136 engages an electrode of spark plug 82.

It should be understood that a weather seal may be used between lower surface 164 of flange 156 and upper surface 118 of valve cover 158 to prevent combustion gas within spark plug tube 112 from escaping between the metal-to-metal interface between lower surface 164 of flange 156 and upper surface 118 of valve cover 158. As a gap 144 is provided between lower end 135 of body 154 and the body of spark plug 82, blow-by gases may be passed into gap 114 and vented using the teachings of the Flame Arrestor Application. The upper end 146 of extender body 154 includes a cup 148 in electrical contact with spring 140 which contacts conductor 138. Cup 148 includes threads 149 which mate with a secondary lead 22 (such as that depicted in FIG. 1B). A remote mounted coil (such as coil 24 of FIG. 1B) may then be connected to secondary lead 22 to complete the electrical connection between spark plug 82 and the remote mounted coil.

Thus, configuration 150 also provides a shielded ignition configuration that permits use of conventional spark plugs 82. Additionally, configuration 150 permits use of a shielded coil (such as coil 24 of FIG. 1B) mounted at a location on the engine that will reduce the temperature and vibration imparted to the coil relative to a valve cover mounted coil. Also, when the teachings of the Flame Arrestor Application are incorporated into configuration 150, configuration 150 may include a weather seal as described above between lower surface 164 of flange 156 and upper surface 118 of valve cover 158 to prevent ingress of fluids into and egress of flames from gap 114, thereby avoiding corrosion of the electrical connection between spark plug 82 and extender 154 while permitting safe use of configuration 150 in hazardous environments.

Figure 7:
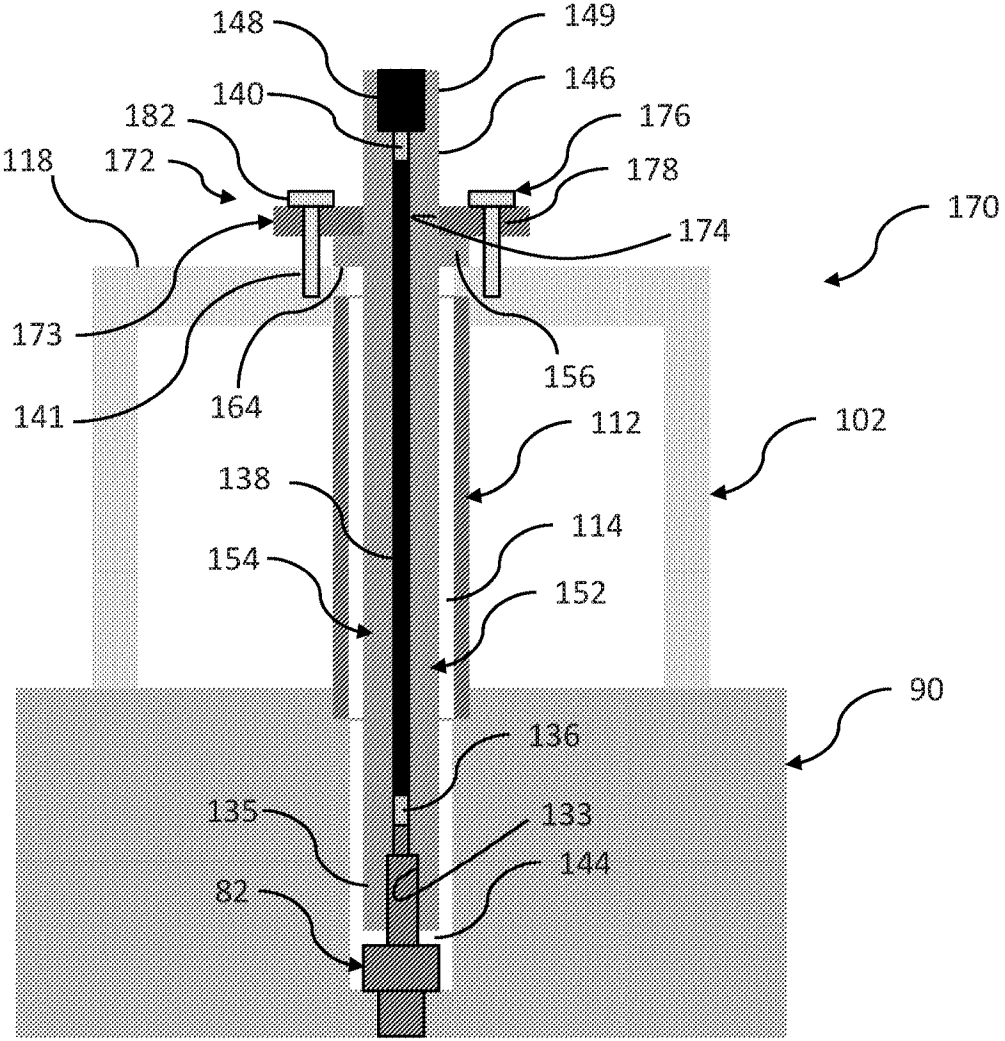
FIG. 7 is a side view of an ignition configuration according to yet another embodiment of the present disclosure.

Referring now to FIG. 7, another embodiment of an ignition configuration according to the present disclosure is shown. Ignition configuration 170 includes components that are the same as those of configuration 130 and configuration 150. Thus, for those components the same reference designations are used. Configuration 170 includes a conventional spark plug 82, a shielded spark plug extender 152, and a spark plug tube 112. Conventional spark plug 82 is the same as that described above with reference to FIG. 4. Spark plug extender 152 includes an elongate body 154 having a lower end 135 with a receptacle 133 that mates with spark plug 82 in the manner described above with reference to spark plug extender 84. Extender 152 further includes a spring contact 136 that provides an electrical connection with spark plug 82 in the manner described above with reference to spark plug extender 84. Spring contact 136 is in electrical contact with conductor 138 of extender 152. The other end of conductor 138 is in electrical contact with another spring contact 140. Extender 152 further includes a flange 156 which extends outwardly from body 154 adjacent upper end 146 of body 154. When extender 152 is positioned onto spark plug 82, a lower surface 164 of flange 156 is in contact with upper surface 118 of valve cover 102. Extender 152 further includes a retainer 172, Retainer 172 includes a plate 173 with a central opening 174 configured to be placed over end 146 of extender 152 and onto flange 156 and a plurality of fasteners 176 which are placed through openings 178 formed through plate 173 and threaded into openings 141 formed in valve cover 102. As fasteners 176 are threaded into openings 141, the heads 182 of fasteners 176 draw plate 173 down onto shoulder 156 of extender 152, thereby causing lower surface 164 of flange 156 to engage upper surface 118 of valve cover 102.

It should be understood that a weather seal may be used between lower surface 164 of flange 156 and upper surface 118 of valve cover 102 to prevent combustion gas within spark plug tube 112 from escaping between the metal-to-metal interface between lower surface 164 of flange 156 and upper surface 118 of valve cover 102. As a gap 144 is provided between lower end 135 of body 154 and the body of spark plug 82, blow-by gases may be passed into gap 114 and vented using the teachings of the Flame Arrestor Application. The upper end 146 of extender body 154 includes a cup 148 in electrical contact with spring 140. Cup 148 includes threads 149 which mate with a secondary lead 22 (such as that depicted in FIG. 1B). A remote mounted coil (such as coil 24 of FIG. 1B) may then be connected to secondary lead 22 to complete the electrical connection between spark plug 82 and the remote mounted coil.

Thus, configuration 170 also provides a shielded ignition configuration that permits use of conventional spark plugs 82. Additionally, configuration 170 permits use of a shielded coil (such as coil 24 of FIG. 1B) mounted at a location on the engine that will reduce the temperature and vibration imparted to the coil relative to a valve cover mounted coil. Also, when the teachings of the Flame Arrestor Application are incorporated into configuration 170, configuration 170 may include a weather seal as described above between lower surface 164 of flange 156 and upper surface 118 of valve cover 102 to prevent ingress of fluids into and egress of flames from gap 114, thereby avoiding corrosion of the electrical connection between spark plug 82 and extender 154 while permitting safe use of configuration 170 in hazardous environments.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A shielded ignition configuration, comprising:

a non-shielded spark plug having an electrode;

a spark plug extender having a first end configured to mount to the spark plug such that a conductor of the extender makes electrical contact with the spark plug electrode, a second end having a cup configured for connection to a secondary lead such that the conductor makes electrical contact with the secondary lead, and a flange; and at least one retainer configured to engage the flange and cause a lower surface of the flange to engage an upper surface of a valve cover.

2. The shielded ignition configuration of claim 1, wherein the at least one retainer comprises a plurality of fasteners that extend through a corresponding plurality of openings in the flange and into a plurality of openings in the valve cover.

3. The shielded ignition configuration of claim 1, wherein the at least one retainer comprises a central opening through which the second end of the extender extends and a plurality of internal threads that mate with corresponding threads formed onto the valve cover.

4. The shielded ignition configuration of claim 1, wherein the at least one retainer comprises a plate having a central opening through which the second end of the extender extends, and a plurality of fasteners that extend through a corresponding plurality of openings in the plate and into a plurality of openings in the valve cover.

5. The shielded ignition configuration of claim 1, wherein the first end comprises a receptacle structured for coupling to the spark plug and wherein the spark plug extender mounts to the spark plug by way of the receptacle.

6. The shielded ignition configuration of claim 5, wherein the receptacle comprises at least one of a seal and a boot disposed within the receptacle to cause a system dielectric strength to change from a first strength value to a second strength value, the second strength value being greater than the first strength value.

7. The shielded ignition configuration of claim 1, further including a spark plug tube positioned in an opening of the valve cover, a first gap intermediate the first end and a body of the non-shielded spark plug, and a second gap intermediate an inner wall of the spark plug tube and the spark plug extender.

8. The shielded ignition configuration of claim 7, wherein the first gap is in fluid communication with the second gap such that blow-by gases from a combustion chamber flows from the first gap toward the second gap thereby mitigating corrosion of the spark plug.

9. A shielded spark plug extender, comprising:

an elongate body having a first end and a second end;

a receptacle disposed at the first end configured for coupling to a standard spark plug;

a cup disposed at the second end, the second end having threads to engage corresponding threads on a secondary lead to retain the secondary lead in contact with the cup;

a conductor extending between the receptacle and the cup, the conductor providing electrical connection between the spark plug and the cup;

a flange extending outwardly from the body adjacent the second end, the flange having a lower surface for engaging an upper surface of a valve cover and the flange and the elongate body being formed of a single, unitary piece; and at least one retainer configured to engage the valve cover to retain the lower surface of the flange in engagement with the upper surface of the valve cover.

10. The shielded spark plug extender of claim 9, wherein the at least one retainer comprises a plurality of fasteners that extend through a corresponding plurality of openings in the flange and into a plurality of openings in the valve cover.

11. The shielded spark plug extender of claim 9, wherein the at least one retainer comprises a central opening through which the second end of the extender extends and a plurality of internal threads that mate with corresponding threads formed onto the valve cover.

12. The shielded spark plug extender of claim 9, wherein the at least one retainer comprises a plate having a central opening through which the second end of the extender extends, and a plurality of fasteners that extend through a corresponding plurality of openings in the plate and into a plurality of openings in the valve cover.

13. The shielded spark plug extender of claim 9, further including a seal positioned intermediate an interface defined by the lower surface of the flange and the upper surface of the valve cover, the seal structured to inhibit flow of combustion gases from a combustion chamber past the first interface.

14. The shielded spark plug extender of claim 9, wherein the receptacle comprises at least one of a seal and a boot disposed within the receptacle to cause a system dielectric strength to change from a first strength value to a second strength value, the second strength value being greater than the first strength value.

15. An engine, comprising:

a cylinder head having at least one spark plug cavity formed therein;

a valve cover mounted to the cylinder head, the valve cover having an upper surface;

a spark plug mounted in the spark plug cavity;

a coil mounted to the engine remotely of the valve cover;

a secondary lead coupled to the coil;

a spark plug tube extending between the cylinder head and the valve cover; and a shielded spark plug extender having an elongate body extending through the tube having a first end extending from the tube into the spark plug cavity and a second end extending from the tube and through the upper surface of the valve cover, a receptacle disposed at the first end configured for coupling to the spark plug, the receptacle having a contact for contacting an electrode of the spark plug, a cup disposed at the second end, the second end having threads to engage corresponding threads on the secondary lead to retain the secondary lead in contact with the cup, a conductor extending between the receptacle and the cup, the conductor providing electrical connection between the spark plug and the cup, a flange extending outwardly from the body adjacent the second end, the flange having a lower surface for engaging the upper surface of the valve cover, and at least one retainer configured to engage the valve cover to retain the lower surface of the flange in engagement with the upper surface of the valve cover.

16. The engine of claim 15, wherein the at least one retainer comprises a plurality of fasteners that extend through a corresponding plurality of openings in the flange and into a plurality of openings in the valve cover.

17. The engine of claim 15, wherein the at least one retainer comprises a central opening through which the second end of the extender extends and a plurality of internal threads that mate with corresponding threads formed onto the valve cover.

18. The engine of claim 15, wherein the at least one retainer comprises a plate having a central opening through which the second end of the extender extends, and a plurality of fasteners that extend through a corresponding plurality of openings in the plate and into a plurality of openings in the valve cover.

19. The engine of claim 15, wherein the receptacle comprises at least one of a seal and a boot disposed within the receptacle to cause a system dielectric strength to change from a first strength value to a second strength value, the second strength value being greater than the first strength value.

20. The engine of claim 15, further including a first gap intermediate the first end and a body of the spark plug, and a second gap intermediate an inner wall of the spark plug tube and the shielded spark plug extender.

21. The engine of claim 20, wherein the first gap is in fluid communication with the second gap such that blow-by gases from a combustion chamber flows from the first gap toward the second gap thereby mitigating corrosion of the spark plug.

* * * * *